US010884355B2

(12) United States Patent
Nohara et al.

(10) Patent No.: US 10,884,355 B2
(45) Date of Patent: Jan. 5, 2021

(54) IMAGE FORMING APPARATUS

(71) Applicant: KYOCERA Document Solutions Inc., Osaka (JP)

(72) Inventors: Yuta Nohara, Osaka (JP); Tomohiko Yamakawa, Osaka (JP); Hiroaki Ohashi, Osaka (JP); Masaru Takagi, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/710,912

(22) Filed: Dec. 11, 2019

(65) Prior Publication Data

US 2020/0117117 A1 Apr. 16, 2020

Related U.S. Application Data

(62) Division of application No. 16/127,689, filed on Sep. 11, 2018, now Pat. No. 10,545,430.

(30) Foreign Application Priority Data

Sep. 21, 2017 (JP) ..... 2017-181106

(51) Int. Cl.
*G03G 15/08* (2006.01)
*G03G 15/16* (2006.01)
*G03G 15/01* (2006.01)

(52) U.S. Cl.
CPC ..... *G03G 15/087* (2013.01); *G03G 15/0868* (2013.01); *G03G 15/0879* (2013.01); *G03G 15/16* (2013.01); *G03G 15/0126* (2013.01)

(58) Field of Classification Search
None
See application file for complete search history.

(56) References Cited

U.S. PATENT DOCUMENTS

| | | | | |
|---|---|---|---|---|
| 5,091,748 | A | 2/1992 | Morisawa et al. | |
| 2006/0133856 | A1* | 6/2006 | Deguchi | G03G 15/0872 399/262 |
| 2010/0189470 | A1* | 7/2010 | Yoshizawa | G03G 15/0886 399/262 |

FOREIGN PATENT DOCUMENTS

JP 2014-157350 8/2014

OTHER PUBLICATIONS

Weisstein, Eric W. "Circle Packing." from MathWorld—A Wolfram Web Resource. (available at: https://web.archive.org/web/20120225210910/http://mathworld.wolfram.com/CirclePacking.html) (Feb. 25, 2012).

* cited by examiner

*Primary Examiner* — Sevan A Aydin
(74) *Attorney, Agent, or Firm* — Gerald E. Hespos; Michael J. Porco; Matthew T. Hespos

(57) ABSTRACT

An image forming unit of an image forming apparatus includes a developing device and a toner replenishing unit that replenishes the developing device with toner. The toner replenishing unit includes an upper toner container, a lower toner container, a toner conveyance unit. The upper toner container and the lower toner container are disposed in a staggered manner in an apparatus body.

4 Claims, 11 Drawing Sheets

IMAGE FORMING APPARATUS

CROSS-REFERENCE TO RELATED APPLICATIONS

This application is a divisional of U.S. patent application Ser. No. 16/127,689, filed on Sep. 11, 2018.

BACKGROUND

The present disclosure relates to an image forming apparatus for forming an image on a sheet.

Conventionally, an image forming apparatus that employs an electrophotographic method such as a printer and a copying machine includes a photoreceptor drum that supports an electrostatic latent image, a developing device that supplies the photoreceptor drum with toner to visualize the electrostatic latent image in a toner image, and a transfer device that transfers the toner image from the photoreceptor drum to a sheet.

An image forming apparatus including a plurality of developing devices corresponding to color toners of respective colors in which two toner containers for supplying each developing device with replenishing toner are disposed is known. Even when one of the toner containers becomes empty, it is possible to replenish the toner from the other toner container. This will shorten forced stop time (non-printable time) of the image forming apparatus. Particularly, when a print job including a large number of printing sheets is executed, it is possible to prevent the job from being interrupted halfway because the image forming apparatus is out of toner.

SUMMARY

An image forming apparatus according to an aspect of the present disclosure includes: an apparatus body; at least one image forming unit configured to form a toner image; and a transfer unit configured to transfer the toner image onto a sheet. The image forming unit includes a photoreceptor drum, a developing device, and a toner replenishing unit. The photoreceptor drum is rotated about a predetermined axis and has a peripheral surface that allows formation of an electrostatic latent image and supports a toner image corresponding to the electrostatic latent image. The developing device supplies the photoreceptor drum with toner to visualize the electrostatic latent image in the toner image. The developing device includes a toner replenishing port for internally receiving the toner. The toner replenishing unit is disposed above the developing device and replenishes the developing device with the toner through the toner replenishing port. The toner replenishing unit includes a first toner container, a second toner container, a first container mounting unit, a second container mounting unit, a toner conveyance unit, and a replenishment control unit. The first toner container extends along an axial direction of the photoreceptor drum, and can store the toner in the first toner container and discharge the toner. The second toner container extends along the axial direction, and can store the toner in the second toner container and discharge the toner. The first container mounting unit is disposed with a space above the developing device in the apparatus body. The first container mounting unit allows the first toner container to be mounted along the axial direction, and receives the first toner container. The second container mounting unit is disposed at a position displaced with respect to the first container mounting unit in a direction horizontal and orthogonal to the axial direction above the developing device and below the first container mounting unit in the apparatus body. The second container mounting unit allows the second toner container to be mounted along the axial direction and receives the second toner container. The toner conveyance unit conveys the toner discharged from the first toner container mounted in the first container mounting unit and the second toner container mounted in the second container mounting unit to the developing device. The replenishment control unit controls the toner conveyance unit such that one toner container of the first toner container and the second toner container supplies the developing device with the toner, and when the one toner container becomes empty, another toner container of the first toner container and the second toner container supplies the developing device with the toner.

DETAILED DESCRIPTION

An image forming apparatus 10 according to an embodiment of the present disclosure will be described in detail below with reference to the drawings. As one example of the image forming apparatus, the present embodiment illustrates a tandem color printer. The image forming apparatus may be, for example, a copying machine, a facsimile, a multifunction machine of these machines, or the like. The image forming apparatus may be a printer, a copying machine, or the like that forms a monochrome image.

Figure 1:
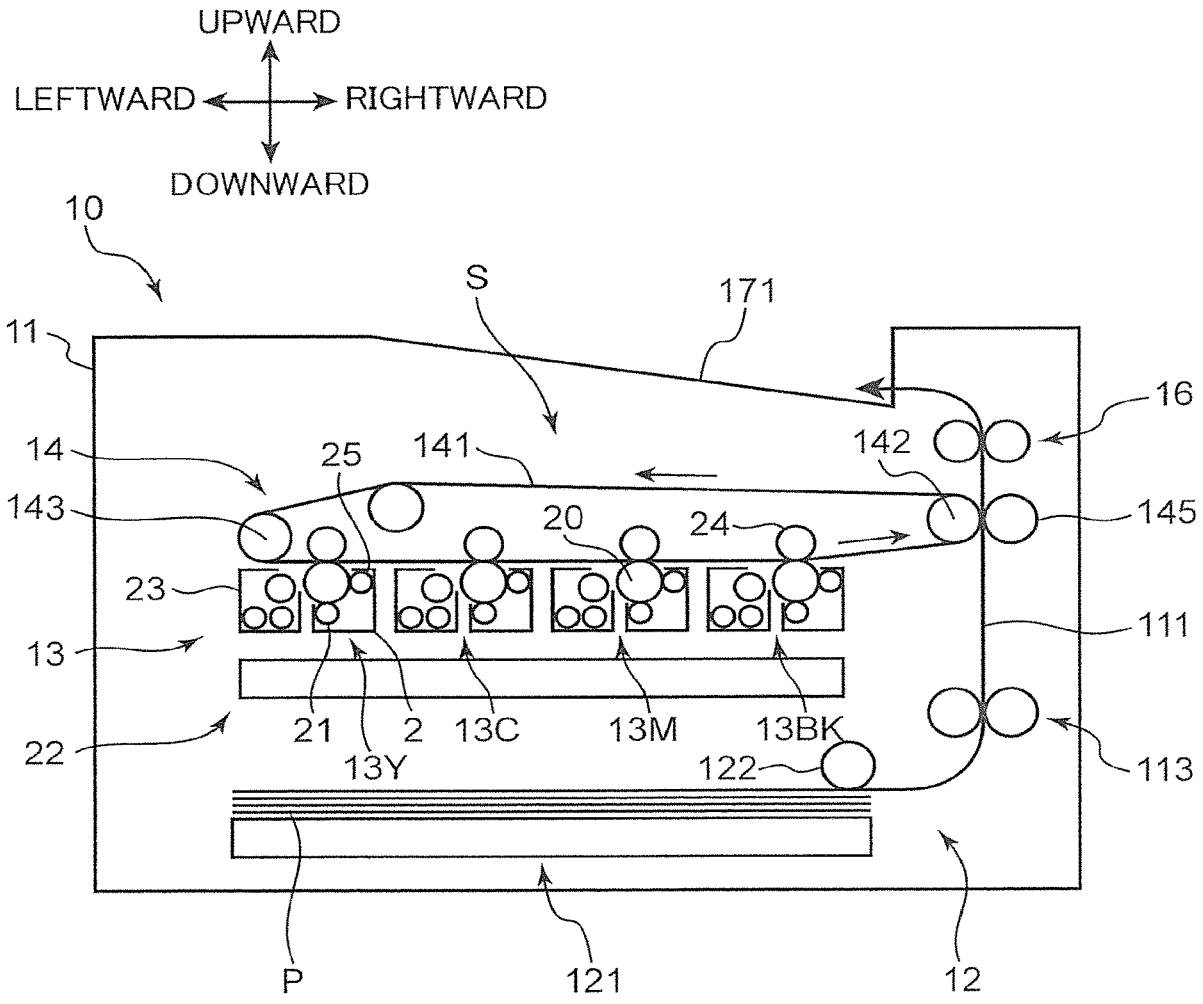
FIG. 1 is a cross-sectional view showing an internal structure of an image forming apparatus according to an embodiment of the present disclosure.

FIG. 1 is a cross-sectional view showing an internal structure of the image forming apparatus 10. The image forming apparatus 10 includes an apparatus body 11 having a box-shaped housing structure. In this apparatus body 11, a sheet feeding unit 12 that feeds a sheet P, an image forming unit 13 that forms a toner image to be transferred onto the sheet P fed from the sheet feeding unit 12, an intermediate transfer unit 14 to which the toner image is primarily transferred, a secondary transfer roller 145, and a fixing unit 16 that performs a process of fixing, onto the sheet P, an unfixed toner image formed on the sheet P are installed. Furthermore, on an upper portion of the apparatus body 11, there is provided a sheet discharge portion 171 into which the sheet P that has undergone the fixation process in the fixing unit 16 is ejected.

In the apparatus body 11, a vertically extending sheet conveyance path 111 is further formed at a position on a right side of the image forming unit 13. A pair of conveyance rollers for conveying the sheet P is provided at an appropriate position on the sheet conveyance path 111. In addition, a pair of registration rollers 113 for correcting skew of the sheet P and feeding the sheet P at a predetermined timing to a secondary transfer nip to be described later is also provided on an upstream side of the nip on the sheet conveyance path 111. The sheet conveyance path 111 is a conveyance path that conveys the sheet P from the sheet feeding unit 12 to the sheet discharge portion 171 via the image forming unit 13 (secondary transfer nip) and the fixing unit 16.

The sheet feeding unit 12 includes a sheet feeding tray 121 and a pickup roller 122. The sheet feeding tray 121 is detachably mounted in a lower position of the apparatus body 11, and stores a sheet bundle in which a plurality of sheets P are stacked. The pickup roller 122 feeds the uppermost sheet P of the sheet bundle stored in the sheet feeding tray 121 one by one.

The image forming unit 13 forms a toner image to be transferred onto the sheet P, and includes a plurality of image forming units for forming toner images of different colors. As these image forming units, in the present embodiment, a yellow unit 13Y using a yellow (Y) toner, a cyan unit 13C using a cyan (C) toner, a magenta unit 13M using a magenta (M) toner, and a black unit 13BK using a black (Bk) toner which are sequentially arranged according to toners of a plurality of colors from an upstream side to a downstream side in a rotation direction of an intermediate transfer belt 141, which will be described later (from a left side to a right side in FIG. 1). Each unit includes a photoreceptor drum 20, a charging device 21 disposed around the photoreceptor drum 20, a developing device 23, and a cleaning device 25. In addition, an exposure device 22 common to each unit is disposed below the image forming units.

Figure 2:
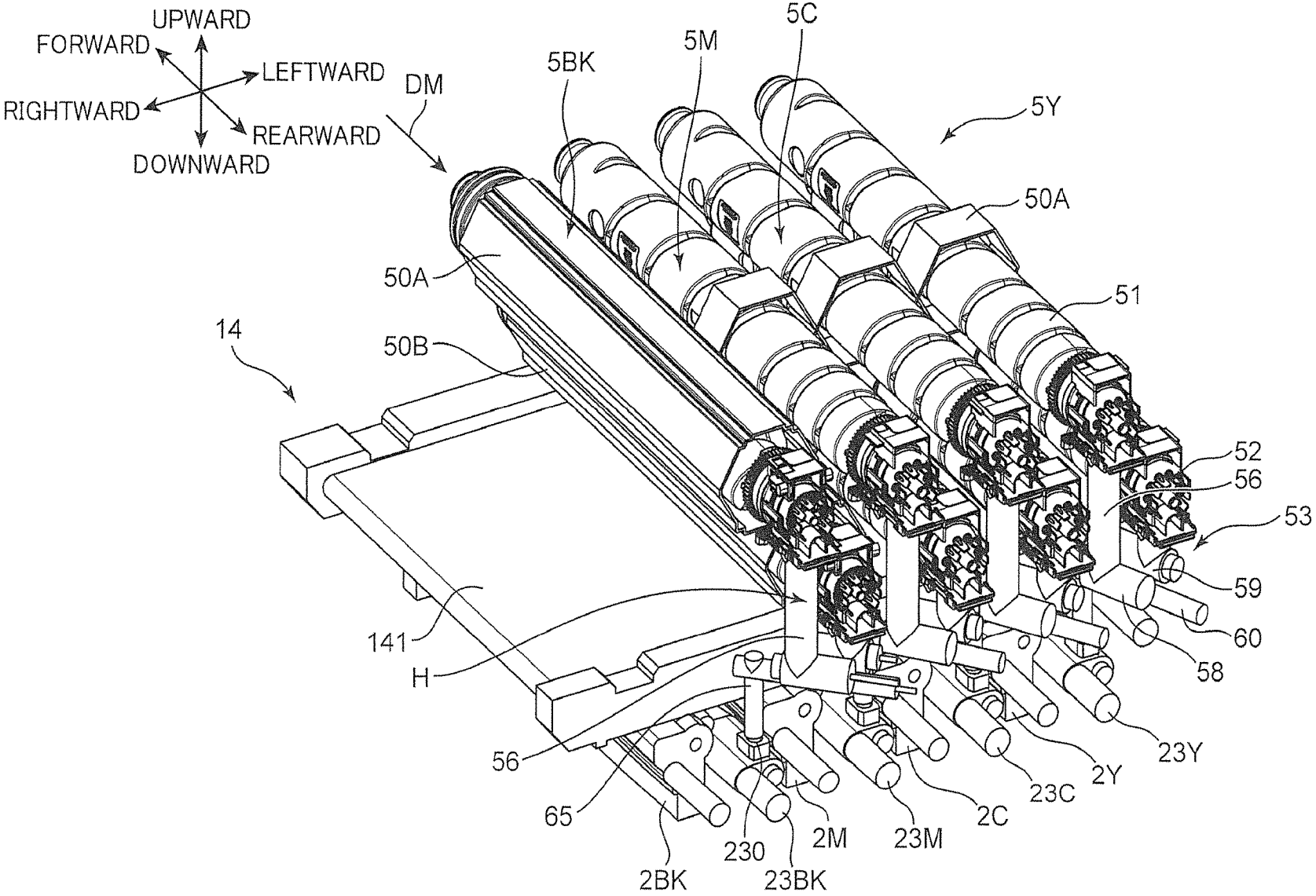
FIG. 2 is a perspective view of an image forming unit of the image forming apparatus according to the embodiment of the present disclosure.

The photoreceptor drum 20 is driven to rotate around a predetermined axis extending in a front-rear direction, and allows the formation of an electrostatic latent image on the peripheral surface thereof and supports the toner image. The charging device 21 uniformly charges a surface of the photoreceptor drum 20. The exposure device 22 includes various optical devices such as a light source, a polygon mirror, a reflection mirror, and a deflection mirror. The exposure device 22 forms an electrostatic latent image by irradiating the peripheral surface of the uniformly charged photoreceptor drum 20 with light modulated based on image data. The cleaning device 25 cleans the peripheral surface of the photoreceptor drum 20 after the toner image transfer. In the present embodiment, the photoreceptor drum 20, the charging device 21, and the cleaning device 25 are integrated with each other to constitute a drum unit 2 (FIGS. 1 and 2).

The developing device 23 supplies the peripheral surface of the photoreceptor drum 20 with toner in order to develop (visualize) the electrostatic latent image formed on the photoreceptor drum 20. The developing device 23 contains magnetic one-component toner as a developer. Note that in the present embodiment, the toner has a characteristic of being charged to positive polarity. In other embodiments, the developing device 23 may employ another developing method such as a two-component developer method including toner and carrier or a nonmagnetic one-component. Note that the developing device 23 includes a toner replenishing port 230 for internally receiving toner (see FIG. 2).

The intermediate transfer unit 14 is disposed above the image forming unit 13. The intermediate transfer unit 14 includes the intermediate transfer belt 141, a driving roller 142, a driven roller 143, and primary transfer rollers 24.

The intermediate transfer belt 141 is an endless belt-shaped rotating body. The intermediate transfer belt 141 is wound around the driving roller 142 and the driven roller 143 such that the peripheral surface side of the intermediate transfer belt 141 is in contact with the peripheral surface of each photoreceptor drum 20. The intermediate transfer belt 141 is driven to rotate in one direction and supports, on its surface, the toner image transferred from the photoreceptor drum 20.

The driving roller 142 stretches the intermediate transfer belt 141 on a left end side of the intermediate transfer unit 14 and drives the intermediate transfer belt 141 to rotate. The driving roller 142 is made of a metal roller. The driven roller 143 stretches the intermediate transfer belt 141 on a right end side of the intermediate transfer unit 14. The driven roller 143 applies tension to the intermediate transfer belt 141.

Each of the primary transfer rollers 24 forms a primary transfer nip together with the photoreceptor drum 20 with the intermediate transfer belt 141 interposed therebetween. The primary transfer roller 24 primarily transfers the toner image on the photoreceptor drum 20 onto the intermediate transfer belt 141. The primary transfer rollers 24 are disposed so as to face the photoreceptor drums 20 of respective colors.

The secondary transfer roller 145 is disposed facing the driving roller 142 with the intermediate transfer belt 141 interposed therebetween. The secondary transfer roller 145 is pressed against the peripheral surface of the intermediate transfer belt 141 to form the secondary transfer nip. The toner image primarily transferred onto the intermediate transfer belt 141 is secondarily transferred to the sheet P fed from the sheet feeding unit 12 in the secondary transfer nip. The intermediate transfer unit 14 and the secondary transfer roller 145 of the present embodiment constitute a transfer unit of the present disclosure. The transfer unit transfers the toner image formed in the image forming unit 13 from the photoreceptor drum 20 to the sheet P.

The sheet P fed to the fixing unit 16 is heated and pressed by passing through a fixation nip. With this operation, the toner image transferred onto the sheet P in the secondary transfer nip is fixed on the sheet P.

The sheet discharge portion 171 is formed by recessing a top portion of the apparatus body 11. The sheet P undergone the fixation process is ejected to the sheet discharge portion 171 via the sheet conveyance path 111 extending from an upper portion of the fixing unit 16.

Figure 6:
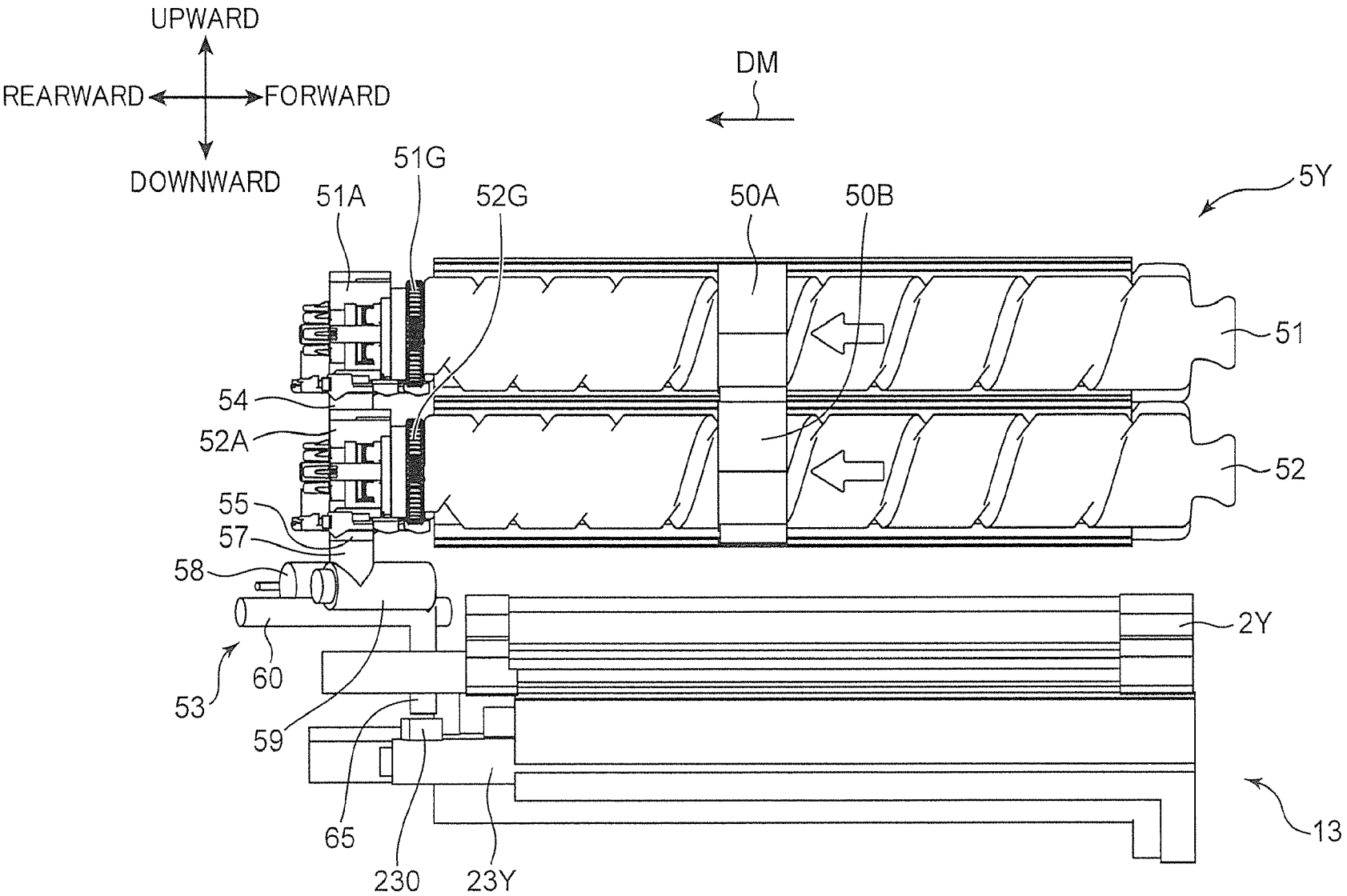
FIG. 6 is a side view of the image forming unit of the image forming apparatus according to the embodiment of the present disclosure.
Figure 7:
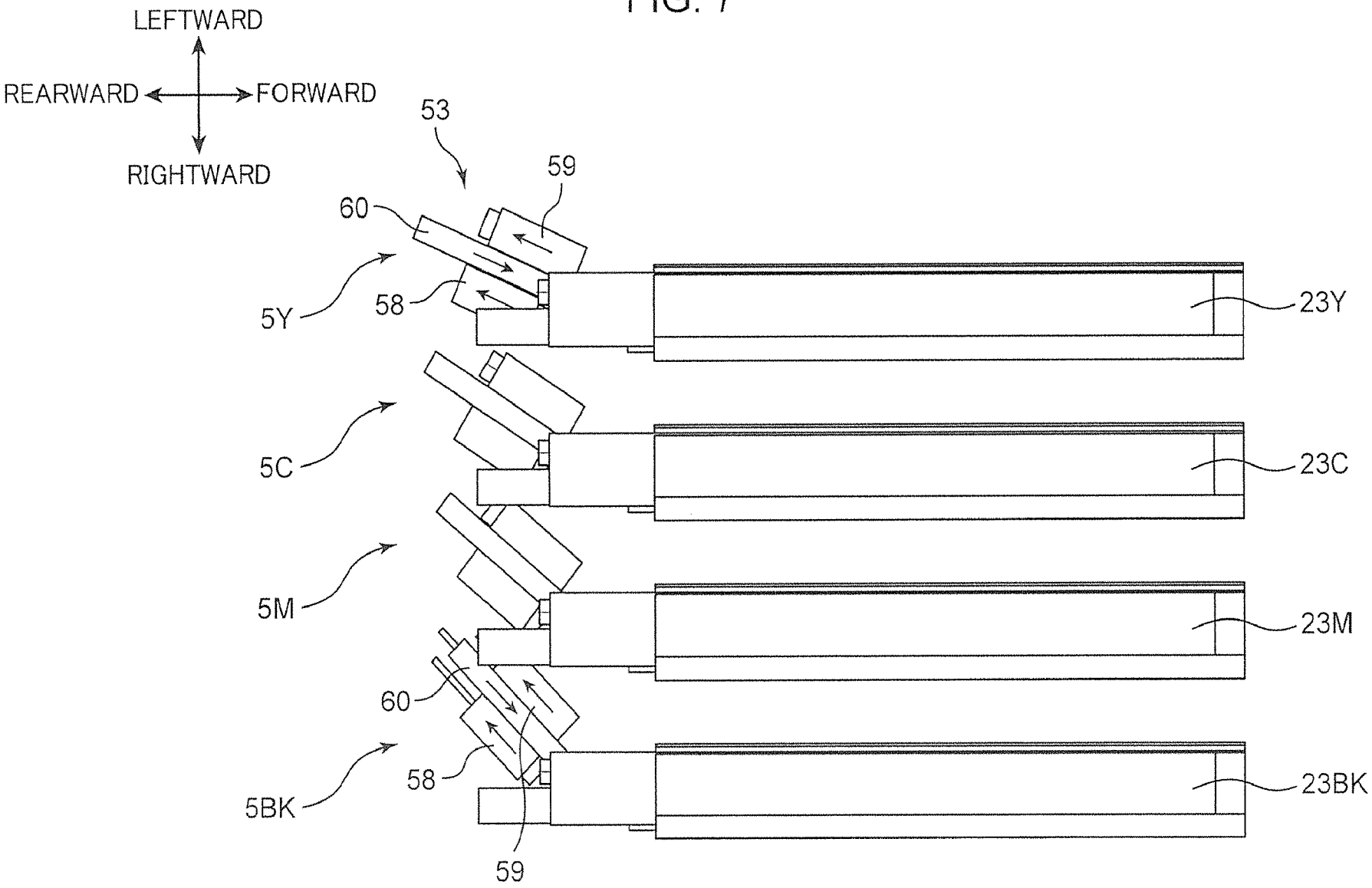
FIG. 7 is a bottom view of the image forming unit of the image forming apparatus according to the embodiment of the present disclosure.

FIGS. 2 to 6 are a perspective view, a front view, a rear view, a bottom view, and a side view of the image forming unit 13 of the image forming apparatus 10 according to the present embodiment, respectively. FIG. 7 is a bottom view of the image forming unit 13 of the image forming apparatus according to the present embodiment. FIG. 7 corresponds to FIG. 5 from which an upper toner container 51 and a lower toner container 52 of each color are removed. FIGS. 8 to 11 are a perspective view, a side view, a rear view, and a bottom view of a yellow toner replenishing unit 5 and the developing device 23 of the image forming apparatus 10 according to the present embodiment.

With reference to FIGS. 2 to 11, the image forming apparatus 10 further includes the toner replenishing units 5. The toner replenishing units 5 are arranged above the developing devices 23 of respective colors and replenish the developing devices 23 with the toner through the toner replenishing ports 230. As shown in FIG. 2, in the present embodiment, the toner replenishing units 5 of respective colors (5BK, 5M, 5C, 5Y) are arranged adjacently to each other in a horizontal direction.

The toner replenishing unit 5 of each color includes an upper toner container 51 (first toner container), a lower toner container 52 (second toner container), an upper housing 50A (first container mounting unit), a lower housing 50B (second container mounting unit), a toner conveyance unit 53, an upper toner receiving unit 54 (first toner receiving unit), and a lower toner receiving unit 55 (second toner receiving unit).

Each of the upper toner container 51 and the lower toner container 52 extends along an axial direction of the photoreceptor drum 20, and can store the toner therein and discharge the toner. The upper toner container 51 and the lower toner container 52 are mounted in the apparatus body 11 of the image forming apparatus 10 along a mounting direction in the axial direction of the photoreceptor drum 20 (arrow DM in FIG. 2). In the present embodiment, each of the upper toner container 51 and the lower toner container 52 has a cylindrical shape, and a helical groove extending helically along the axial direction is formed on the outer peripheral surface thereof (FIGS. 2 and 6). The helical groove forms a helical protrusion protruding into space inside the upper toner container 51 and the lower toner container 52. As will be described later, when the upper toner container 51 and the lower toner container 52 are rotated, the internal toner is conveyed rearward by the helical protrusions. The upper toner container 51 includes a fixed unit 51A and a first container gear 51G (FIG. 6). The fixed unit 51A engages with the upper toner receiving unit 54 and delivers the toner in the upper toner container 51 to the upper toner receiving unit 54. Note that the fixed unit 51A does not rotate. Of the upper toner container 51, a portion forward of the fixed unit 51A is relatively rotatable with respect to the fixed unit 51A. The first container gear 51G is a gear fixed to an outer peripheral portion of the upper toner container 51 forward of the fixed unit 51A. When rotational force is transmitted to the first container gear 51G, a forward portion of the upper toner container 51 rotates.

Similarly, the lower toner container 52 includes a fixed unit 52A and a second container gear 52G (FIG. 6). The fixed unit 52A engages with the lower toner receiving unit 55 and delivers the toner in the lower toner container 52 to the lower toner receiving unit 55. Note that the fixed unit 52A does not rotate. Of the lower toner container 52, a portion forward of the fixed unit 52A is relatively rotatable with respect to the fixed unit 52A. The second container gear 52G is a gear fixed to an outer peripheral portion of the lower toner container 52 forward of the fixed unit 52A. When rotational force is transmitted to the second container gear 52G, a forward portion of the lower toner container 52 rotates.

Figure 8:
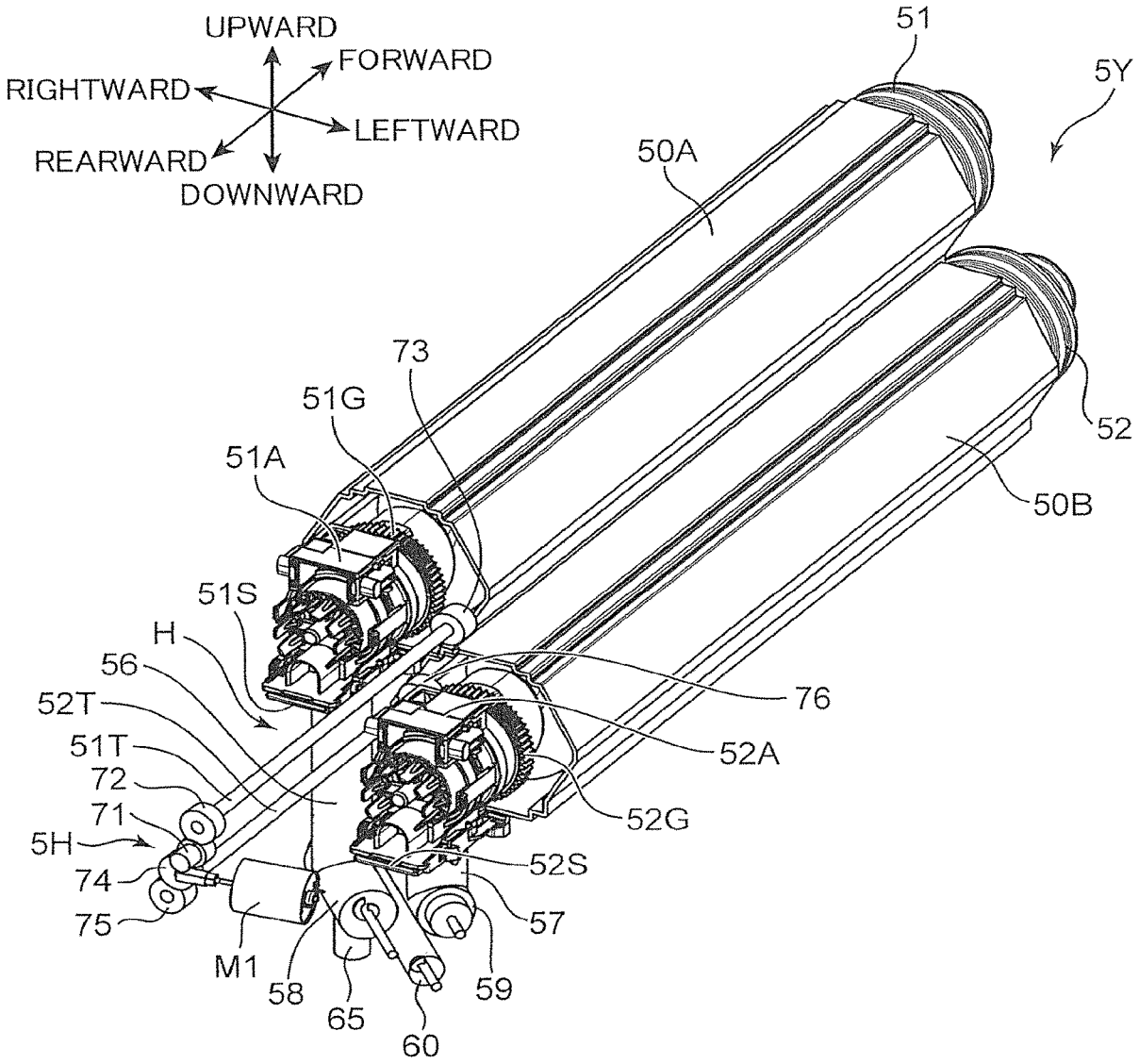
FIG. 8 is a perspective view of a toner replenishing unit and a developing device of the image forming apparatus according to the embodiment of the present disclosure.

Note that the upper toner container 51 includes a first toner discharge port 511 (FIG. 10) formed on a leading end side (fixed unit 51A) in the mounting direction with respect to the upper housing 50A. The lower toner container 52 includes a second toner discharge port 521 (FIG. 10) formed on a leading end side (fixed unit 52A) in the mounting direction with respect to the lower housing 50B. The toner is discharged from these toner discharge ports. Note that the upper toner container 51 and the lower toner container 52 include shutters 51S and 52S that seal the toner discharge ports, respectively (FIG. 8). When the upper toner container 51 and the lower toner container 52 are mounted in the upper housing 50A and the lower housing 50B, respectively, these shutters are slid to open the toner discharge ports. In the present embodiment, the upper toner container 51 and the lower toner container 52 have the same shape. In other words, the toner container of each color applied to the image forming apparatus 10 can be mounted in the upper housing 50A or the lower housing 50B in the toner replenishing unit 5 of the corresponding color. Note that the upper toner container 51 and the lower toner container 52 are disposed in container space S of the apparatus body 11 in FIG. 1.

The upper housing 50A is disposed with a space above the developing device 23 in the apparatus body 11. The upper housing 50A allows the upper toner container 51 to be mounted inside the upper housing 50A along the mounting direction DM, and receives the upper toner container 51. The lower housing 50B is disposed above the developing device 23 and below the upper housing 50A in the apparatus body 11. The lower housing 50B allows the lower toner container 52 to be mounted inside the lower housing 50B along the mounting direction DM, and receives the lower toner container 52. Note that the upper housing 50A and the lower housing 50B may each have a shape extending long in the front-rear direction like the housing at a black position BK in FIG. 2. Alternatively, the upper housing 50A and the lower housing 50B may each have a shape disposed at a central portion in the front-rear direction with a predetermined width like the housing at a yellow position Yin FIG. 2.

Figure 3:
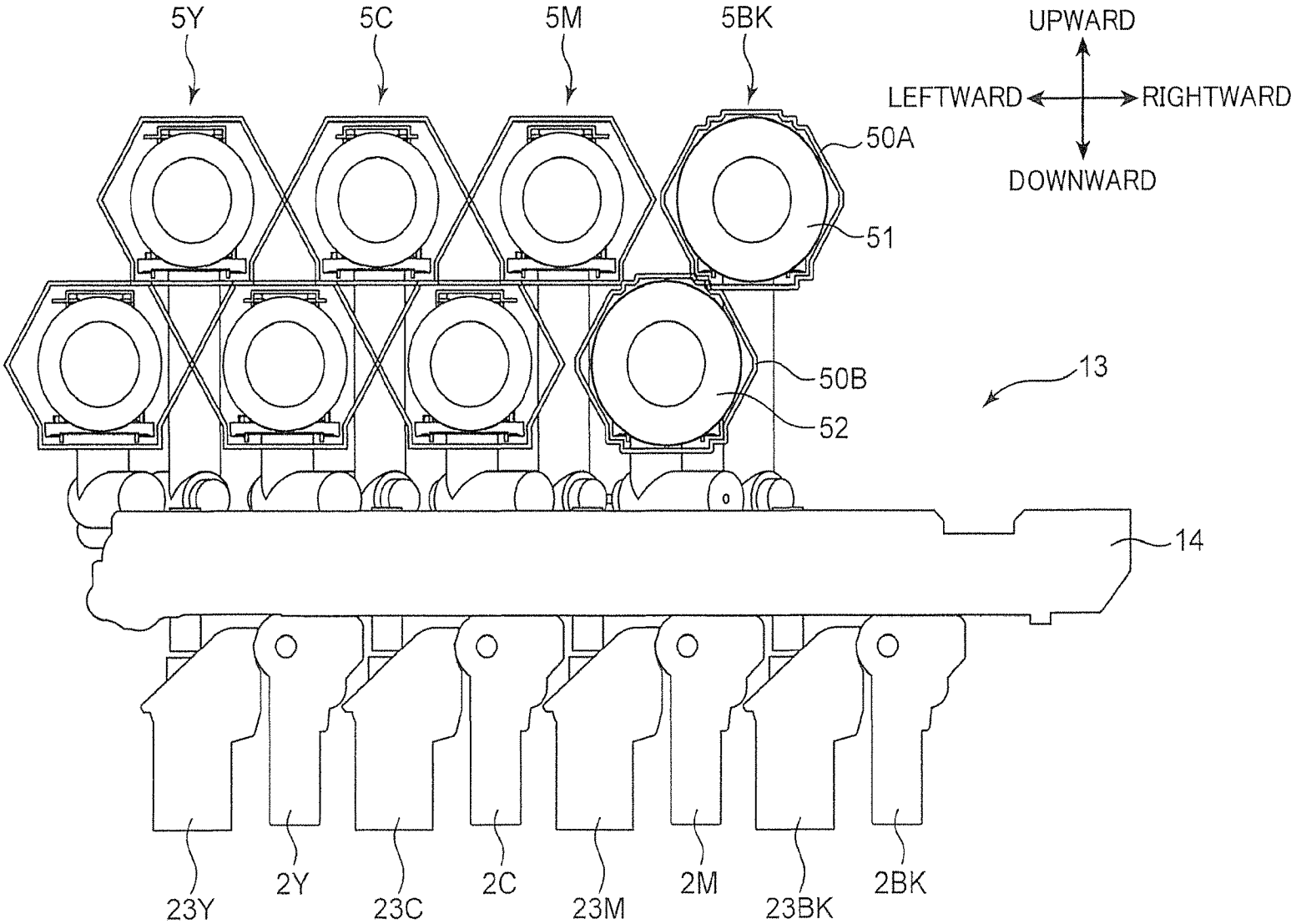
FIG. 3 is a front view of the image forming unit of the image forming apparatus according to the embodiment of the present disclosure.
Figure 4:
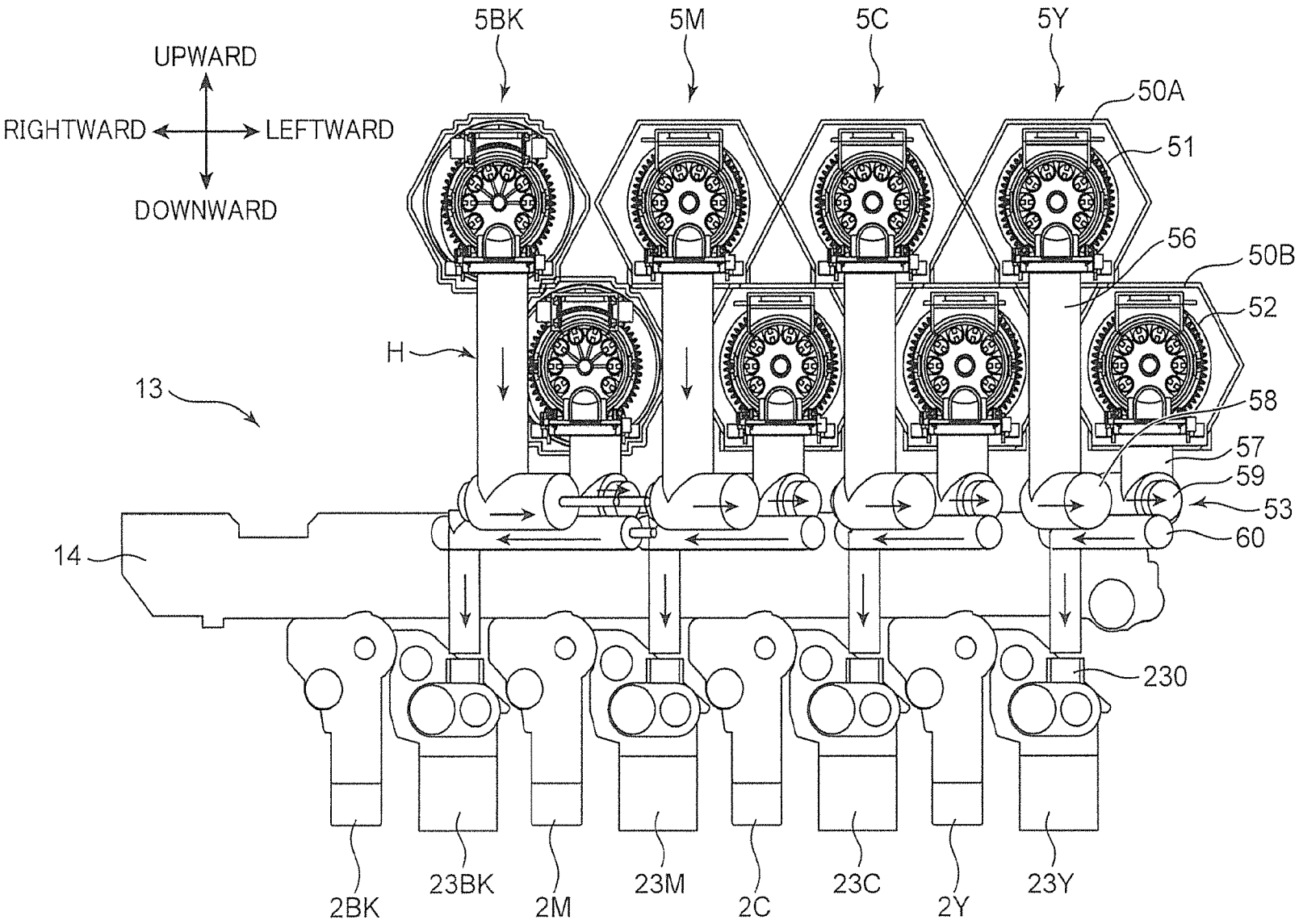
FIG. 4 is a rear view of the image forming unit of the image forming apparatus according to the embodiment of the present disclosure.
Figure 5:
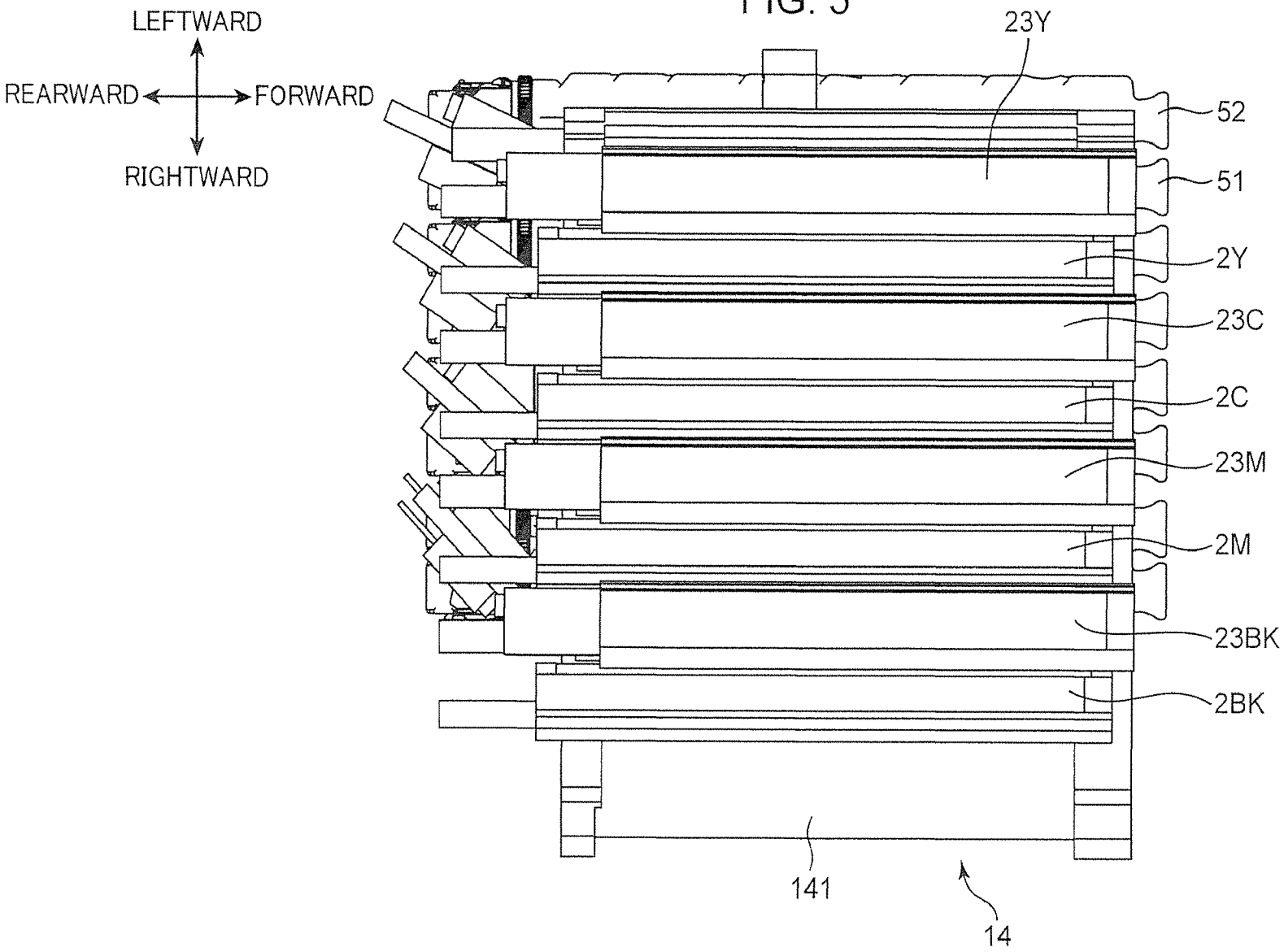
FIG. 5 is a bottom view of the image forming unit of the image forming apparatus according to the embodiment of the present disclosure.

With reference to FIG. 6, in the present embodiment, the lower housing 50B positions the lower toner container 52 in the apparatus body such that with respect to a leading end portion (rear end portion) of the upper toner container 51 mounted in the upper housing 50A in the mounting direction, the leading end portion (rear end portion) of the lower toner container 52 in the mounting direction is placed at an identical position in the mounting direction. Furthermore, the lower housing 50B is disposed at a position displaced from the upper housing 50A in a direction horizontal and orthogonal to the axial direction of the photoreceptor drum 20 (right-left direction) above the developing device 23 and below the upper housing 50A in the apparatus body 11 (FIGS. 2 to 4). As a result, a container step portion H is formed in a space below the leading end portion of the upper toner container 51 in the mounting direction (rear end portion of the upper toner container 51), the space facing the leading end portion in the mounting direction of the lower toner container 52 in a direction horizontal and orthogonal to the axial direction of the photoreceptor drum 20 (FIGS. 2 and 4).

The toner conveyance unit 53 conveys the toner discharged from the upper toner container 51 mounted in the upper housing 50A and the lower toner container 52 mounted in the lower housing 50B to the developing device 23. As will be described later, part of the toner conveyance unit 53 is disposed in the container step portion H described above.

Figure 10:
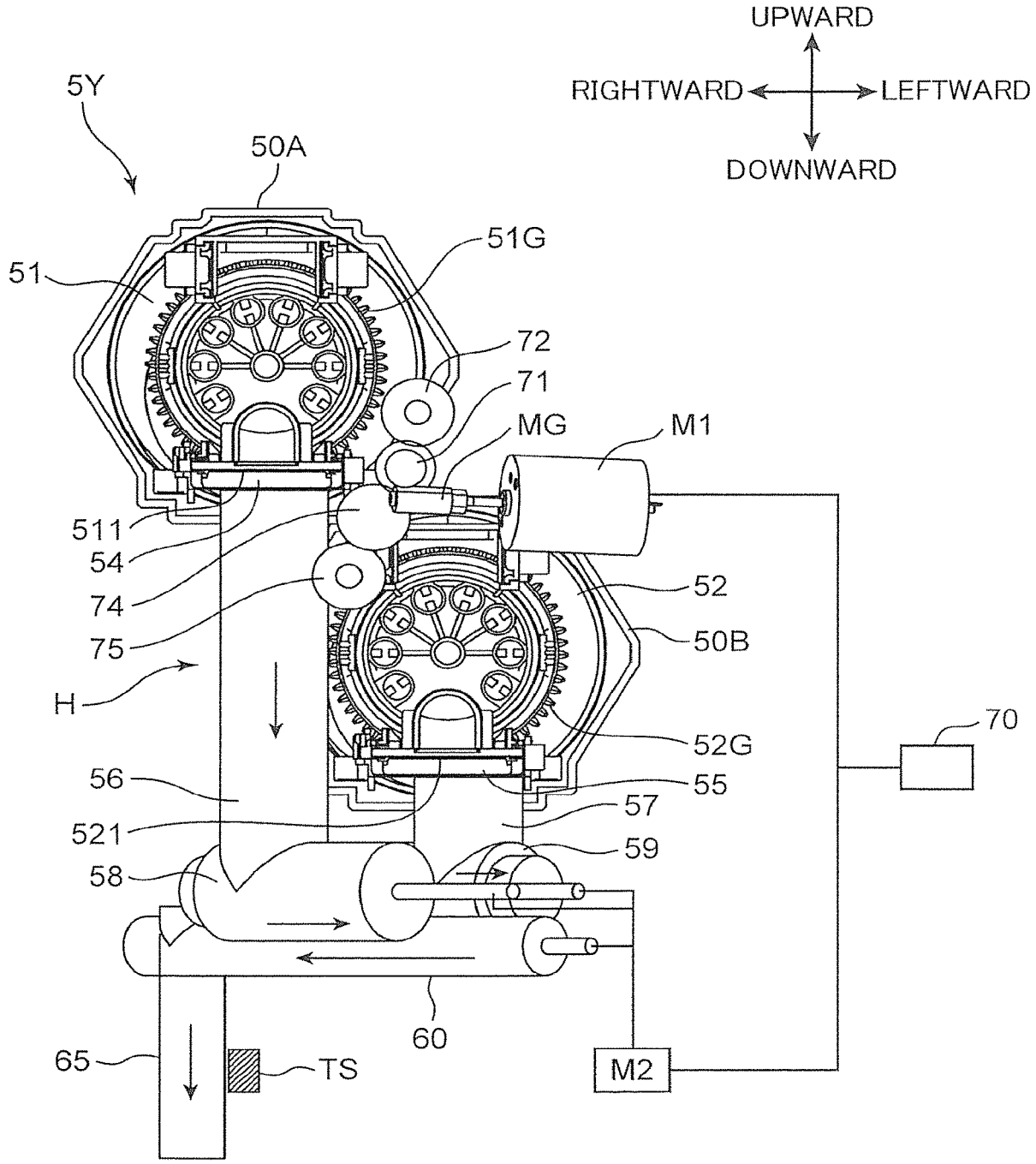
FIG. 10 is a rear view of the toner replenishing unit and the developing device of the image forming apparatus according to the embodiment of the present disclosure.
Figure 11:
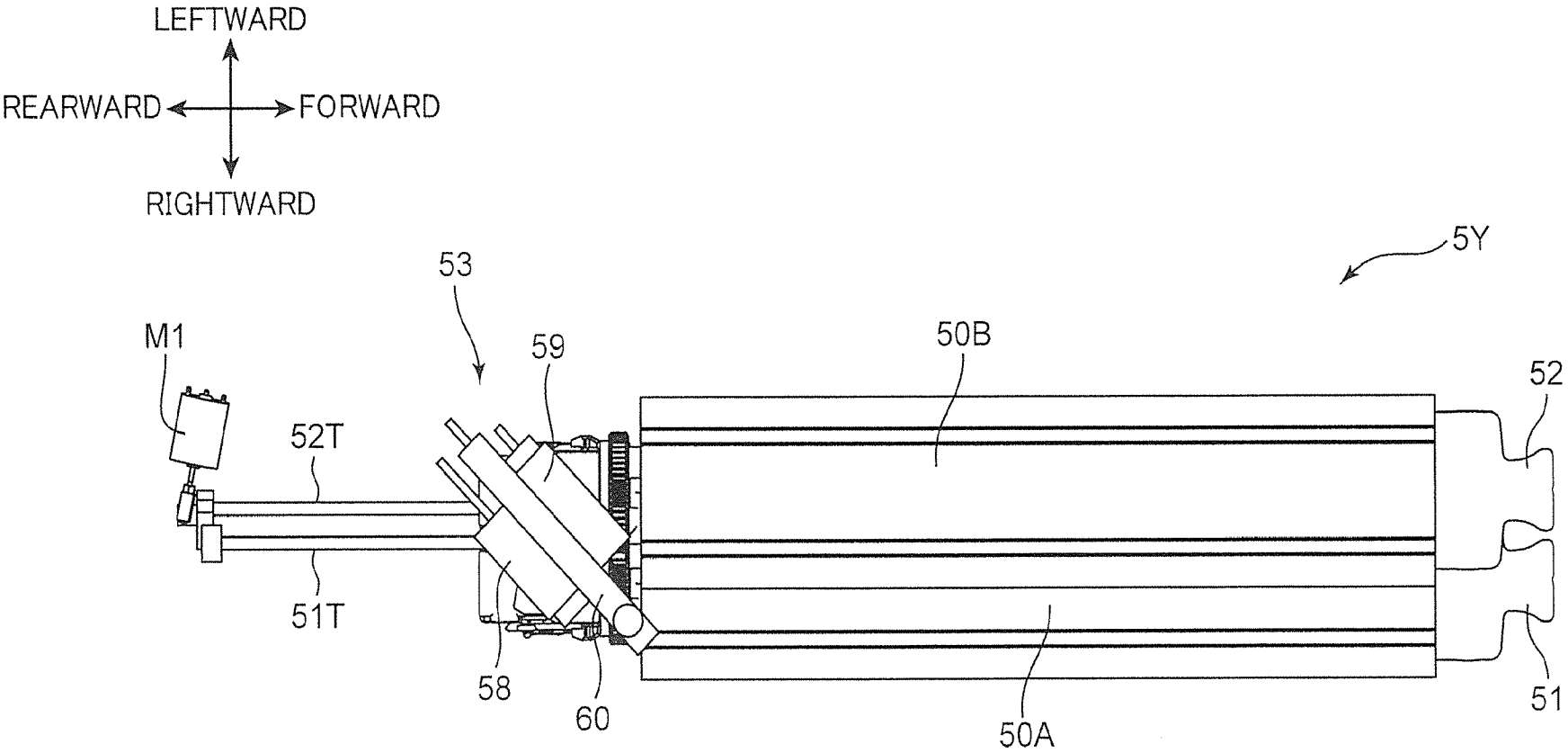
FIG. 11 is a bottom view of the toner replenishing unit and the developing device of the image forming apparatus according to the embodiment of the present disclosure.

The upper toner receiving unit 54 is disposed closer to the leading end side in the mounting direction than the upper housing 50A is. The upper toner receiving unit 54 engages with the leading end portion of the upper toner container 51 in the mounting direction (fixed unit 51A). The upper toner receiving unit 54 receives the toner discharged from the first toner discharge port 511 of the upper toner container 51 (FIG. 10).

The lower toner receiving unit 55 is disposed closer to the leading end side in the mounting direction than the lower housing 50B is. The lower toner receiving unit 55 engages with the leading end portion of the lower toner container 52 in the mounting direction (fixed unit 52A). The lower toner receiving unit 55 receives the toner discharged from the second toner discharge port 521 of the lower toner container 52 (FIG. 10).

Furthermore, the toner conveyance unit 53 includes a first vertical conveyance unit 56 (first longitudinal conveyance unit), a second vertical conveyance unit 57 (second longitudinal conveyance unit), a first horizontal conveyance unit 58 (first lateral conveyance unit), a second horizontal conveyance unit 59 (second lateral conveyance unit), a toner storage unit 60 (joining conveyance unit), and a third vertical conveyance unit 65 (toner supply unit).

The first vertical conveyance unit 56 is a pipe-shaped member disposed on a right side of the rear end portion of the lower toner container 52 and below the upper toner receiving unit 54. In other words, the first vertical conveyance unit 56 is disposed in the container step portion H. The first vertical conveyance unit 56 extends downward from the upper toner receiving unit 54 and conveys the toner downward. Therefore, the upper toner receiving unit 54 and the first vertical conveyance unit 56 communicate with each other.

The second vertical conveyance unit 57 is a pipe-shaped member disposed below the lower toner receiving unit 55. The second vertical conveyance unit 57 extends downward from the lower toner receiving unit 55 and conveys the toner downward. Therefore, the lower toner receiving unit 55 and the second vertical conveyance unit 57 communicate with each other.

The first horizontal conveyance unit 58 is a horizontally extending pipe-shaped member. The first horizontal conveyance unit 58 receives the toner from the first vertical conveyance unit 56 and delivers the toner to the toner storage unit 60 while conveying the toner rearward and leftward along the horizontal direction.

The second horizontal conveyance unit 59 is a horizontally extending pipe-shaped member. The second horizontal conveyance unit 59 receives the toner from the second vertical conveyance unit 57 and delivers the toner to the toner storage unit 60 while conveying the toner rearward and leftward along the horizontal direction.

The toner storage unit 60 is a pipe-shaped member. The toner storage unit 60 receives the toner such that the toner conveyed by the first vertical conveyance unit 56 and the second vertical conveyance unit 57 join through the first horizontal conveyance unit 58 and the second horizontal conveyance unit 59. Also, the toner storage unit 60 further conveys the toner forward and rightward along the horizontal direction.

The third vertical conveyance unit 65 is a pipe-shaped member. The third vertical conveyance unit 65 extends downward from the rear end portion of the toner storage unit 60 and supplies the toner replenishing port 230 of the developing device 23 with the toner. Therefore, the third vertical conveyance unit 65 communicates with the toner storage unit 60 and the developing device 23. Note that in the drawings, the positions of the third vertical conveyance unit 65 and the toner replenishing port 230 are slightly displaced from each other for description.

Note that conveyance screws (not shown) capable of conveying the toner in the horizontal direction by rotating are disposed inside the first horizontal conveyance unit 58, the second horizontal conveyance unit 59, and the toner storage unit 60. Shafts of these conveyance members appear in FIG. 8. In a case where the toner storage unit 60 is filled with the toner, a replenishment amount of the developing device 23 with toner is determined depending on a rotation amount of the conveyance screw. In the present embodiment, the conveyance member as described above is not disposed inside the first vertical conveyance unit 56, the second vertical conveyance unit 57, and the third vertical conveyance unit 65. In other embodiments, however, an agitating member that rotates or moves up and down may be disposed to prevent aggregation of the toner in the conveyance units.

Figure 9:
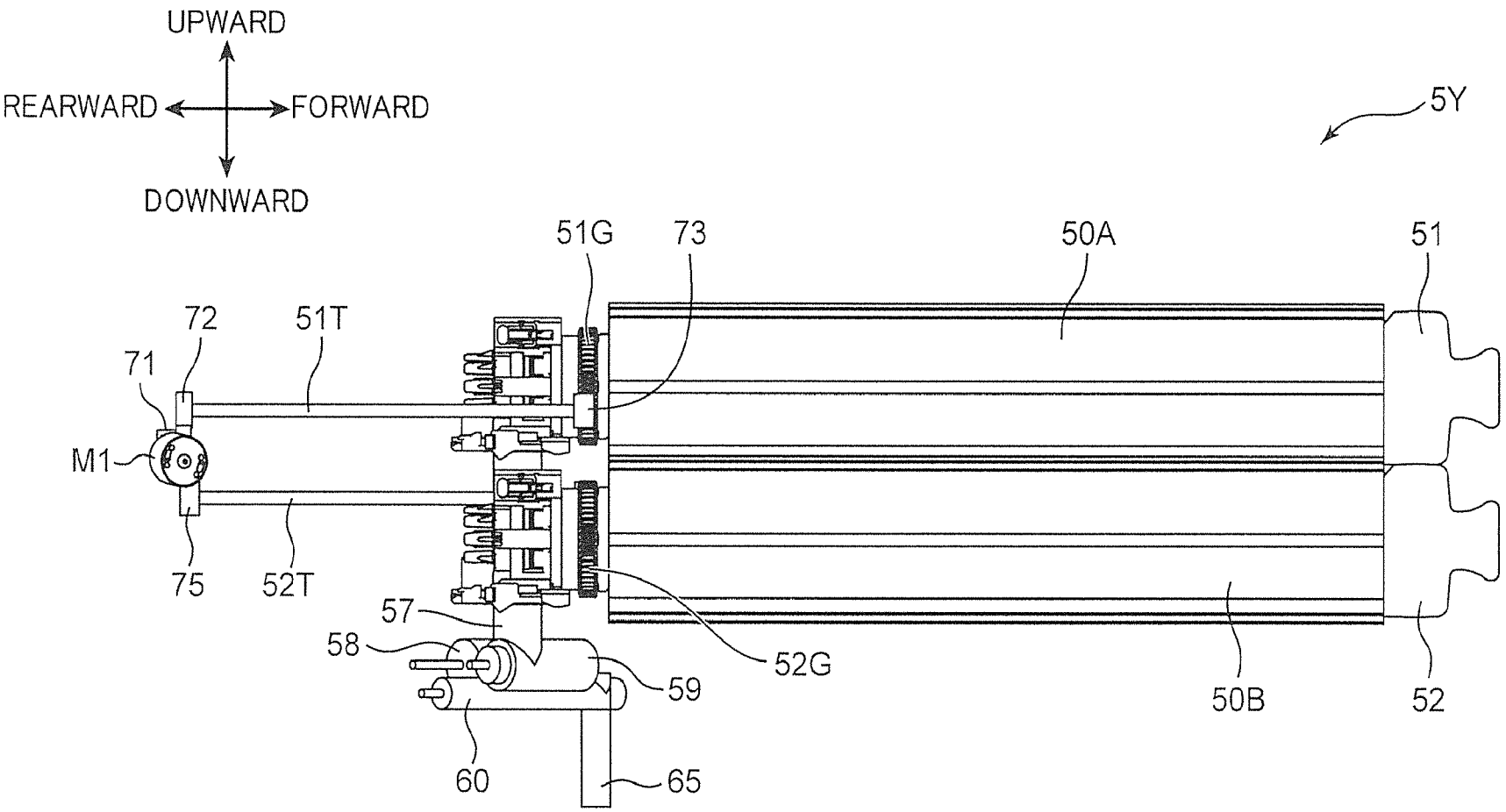
FIG. 9 is a side view of the toner replenishing unit and the developing device of the image forming apparatus according to the embodiment of the present disclosure.

Furthermore, the toner replenishing unit 5 includes a first motor M1 (FIG. 10), a drive transmission unit 5H (FIG. 8), a second motor M2, a toner sensor TS, and a replenishment control unit 70 (FIGS. 9 and 10). The drive transmission unit 5H includes a first gear 71, a first one-way gear 72, a second gear 73, a third gear 74, a second one-way gear 75, and a fourth gear 76.

The first motor M1 generates a rotational driving force for rotating the upper toner container 51 and the lower toner container 52. The first motor M1 is rotatable in a first rotation direction and a second rotation direction opposite to the first rotation direction, and generates the rotational driving force. A motor shaft MG of the first motor M1 is coupled to the first gear 71 including a double gear. The first gear 71 is coupled to the first container gear 51G of the upper toner container 51 via the first one-way gear 72 and the second gear 73 (FIG. 10). Note that as shown in FIG. 8, the first one-way gear 72 and the second gear 73 are fixed to both end portions of a shaft 51T extending in the front-rear direction.

Furthermore, the first gear 71 is coupled to the third gear 74 at a position different from the first one-way gear 72 in a circumferential direction. The first gear 71 is coupled to the second container gear 52G (FIG. 10) of the lower toner container 52 via the third gear 74, the second one-way gear 75, and the fourth gear 76 (FIG. 8). Note that as shown in FIG. 8, the second one-way gear 75 and the fourth gear 76 are fixed to both end portions of a shaft 52T extending in the front-rear direction.

When the first motor M1 is rotated in the first rotation direction, by transmitting the rotational driving force to the first container gear 51G of the upper toner container 51, the drive transmission unit 5H allows the toner to be discharged from the first toner discharge port 511 of the upper toner container 51. At this time, the rotation of the lower toner container 52 is restricted by the second one-way gear 75. Therefore, the toner is not replenished from the lower toner container 52. Meanwhile, when the first motor M1 is rotated in the second rotation direction, by transmitting the rotational driving force to the second container gear 52G of the lower toner container 52, the drive transmission unit 5H allows the toner to be discharged from the second toner discharge port 521 of the lower toner container 52. At this time, the rotation of the upper toner container 51 is restricted by the first one-way gear 72. Therefore, the toner is not replenished from the upper toner container 51. In this way, it is possible to selectively supply the toner from the upper toner container 51 and the lower toner container 52 by the single first motor M1 and the drive transmission unit 5H.

The second motor M2 is coupled to the conveyance screws disposed in the first horizontal conveyance unit 58, the second horizontal conveyance unit 59, and the toner storage unit 60. The second motor M2 generates a rotational driving force for rotating these conveyance screws.

The toner sensor TS is disposed facing the third vertical conveyance unit 65 (FIG. 10). The toner sensor TS includes a magnetic permeability sensor and detects the toner with which the third vertical conveyance unit 65 is filled. When sufficient toner exists inside the third vertical conveyance unit 65, the toner sensor TS outputs a HIGH signal (+5V). On the other hand, when almost no toner exists inside the third vertical conveyance unit 65, the toner sensor TS outputs a LOW signal (0V). Note that in other embodiments, the toner sensor TS may be a PI sensor (photosensor). In this case, the third vertical conveyance unit 65 is formed of a transparent pipe member, and the PI sensor detects whether there is toner in the third vertical conveyance unit 65.

The replenishment control unit 70 controls the rotation of the first motor M1 and the second motor M2. In particular, the replenishment control unit 70 controls each motor in response to output of the toner sensor TS. As one example, the replenishment control unit 70 controls each motor of the toner replenishing unit 5 such that one toner container of the upper toner container 51 and the lower toner container 52 supplies the developing device 23 with the toner, and when the one toner container becomes empty, the other toner container of the upper toner container 51 and the lower toner container 52 supplies the developing device 23 with the toner. The upper toner container 51 and the lower toner container 52 being empty of toner (toner empty) may be detected with rotation time of the upper toner container 51 and the lower toner container 52, or may be detected with output of the toner sensor TS. First, the toner is supplied from the upper toner container 51 to the developing device 23 by rotating the first motor M1 in the first rotation direction and rotating the second motor M2 in a predetermined rotation direction. After a while, in a case where the toner sensor TS continues to output the LOW signal although the upper toner container 51 is being rotated, the replenishment control unit 70 determines that the upper toner container 51 has become empty and switches toner replenishment from the upper toner container 51 to the lower toner container 52. That is, the replenishment control unit 70 supplies the toner from the lower toner container 52 to the developing device 23 by rotating the first motor M1 in the second rotation direction and rotating the second motor M2 in the predetermined rotation direction.

As described above, in the present embodiment, two toner containers are disposed with respect to the developing device 23 in the apparatus body 11. The upper toner container 51 and the lower toner container 52 are adjacently disposed in the vertical and horizontal directions (diagonally) in the apparatus body 11. Therefore, as compared with a case where two toner containers are adjacently disposed only in the horizontal direction, an increase in a horizontal width of the apparatus body 11 is inhibited. Also, the replenishment control unit 70 controls a drive system of the toner replenishing unit 5 such that one toner container of the upper toner container 51 and the lower toner container 52 supplies the developing device 23 with the toner, and when the one toner container becomes empty, the other toner container of the upper toner container 51 and the lower toner container 52 supplies the developing device 23 with the toner. Therefore, even when the upper toner container 51 becomes empty, the lower toner container 52 promptly enables execution of an image forming operation. As a result, it is possible to reduce the frequency and time at which the image forming operation stops following replacement of the toner container.

In the present embodiment, the upper toner container 51 and the lower toner container 52 are disposed at an identical position in the mounting direction in the apparatus body 11. Therefore, as compared with a case where the upper toner container 51 and the lower toner container 52 are displaced with respect to each other in the front-rear direction, a size of the apparatus body 11 in the front-rear direction is reduced. It is possible to efficiently dispose the toner replenishing unit 5 by using the container step portion H formed by the two toner containers.

In the present embodiment, the first vertical conveyance unit 56 is provided to convey downward the toner discharged from the upper toner container 51 located above the lower toner container 52. The first vertical conveyance unit 56 can be disposed by using the container step portion H. Therefore, as compared with a case where the lower toner container 52 is disposed immediately under the upper toner container 51, the first vertical conveyance unit 56 can be disposed efficiently.

Furthermore, in the present embodiment, the toner replenishing unit 5 includes the first horizontal conveyance unit 58 and the second horizontal conveyance unit 59. Therefore, as compared with a case where the toner flows directly from the first vertical conveyance unit 56 and the second vertical conveyance unit 57 into the toner storage unit 60, it is possible to stably fill the toner storage unit 60 with the toner. As a result, replenishment of the developing device 23 with the toner via the third vertical conveyance unit 65 can be stably executed.

Furthermore, in the present embodiment, the toner replenishing port 230 of the developing device 23 is disposed closer to a trailing end side in the mounting direction than the leading end portion of the upper toner container 51 in the mounting direction is. Therefore, as compared with a case where the toner replenishing port 230 is located closer to the leading end side in the mounting direction than the upper toner container 51 is, it is possible to reduce the size of the apparatus body 11 in the mounting direction.

In the present embodiment, the transmission of the rotational driving force to the upper toner container 51 and the lower toner container 52 is switched according to the rotation direction of the first motor M1. Therefore, it is possible to selectively supply the toner from the upper toner container 51 and the lower toner container 52 by the single first motor M1 and the drive transmission unit 5H.

In the present embodiment, the image forming unit 13 includes a plurality of image forming units 13BK, 13M, 13C, and 13Y arranged according to the toners of the plurality of colors. The upper toner containers 51 of the plurality of image forming units are arranged adjacently to each other in the horizontal direction. The lower toner containers 52 of the plurality of image forming units are arranged adjacently to each other in the horizontal direction. Furthermore, when viewed along the axial direction of the photoreceptor drum 20, the upper toner containers 51 and the lower toner containers 52 of the plurality of image forming units are arranged in a staggered manner. Therefore, even in a case where an image is formed on the sheet P with the toners of the plurality of colors, the frequency at which the image forming operation stops following replacement of the toner container is reduced and the increase in the horizontal width of the apparatus body 11 is inhibited. As shown in FIG. 2, the intermediate transfer unit 14 is disposed by using a height at which the toner is replenished from the upper toner container 51 and the lower toner container 52 of each color to the developing device 23. In other words, the toner replenishing units 5 of respective colors are disposed using the positions above and behind the intermediate transfer unit 14.

As shown in FIGS. 2 and 4, in the toner replenishing units 5BK, 5M, and 5C, the adjacent drum unit 2 (photoreceptor drum 20) of another color is disposed immediately under the first vertical conveyance unit 56. In order to replenish, with the toner, the toner replenishing port 230 of the developing device 23 corresponding to the color of the toner replenishing unit located rightward from the position immediately under the first vertical conveyance unit 56, the first horizontal conveyance unit 58, the second horizontal conveyance unit 59, and the toner storage unit 60 convey the toner in the horizontal direction. At this time, the replenishment amount of the developing device 23 with toner is stably maintained by filling the toner storage unit 60 with toner. A length of the toner storage unit 60 in the horizontal direction is set to be long, and in order to secure a toner filling amount in the toner storage unit 60, the first horizontal conveyance unit 58 and the second horizontal conveyance unit 59 convey the toner in a direction opposite to the toner storage unit 60 (in a direction away from the developing device 23). As a result, after toner empty is detected, the number of sheets on which an image can be formed on the sheet P is secured depending on the amount of toner in the toner storage unit 60.

In the present embodiment, as shown in FIG. 4, when viewed along the axial direction of the photoreceptor drum 20, at least part of the toner storage unit 60 of one image forming unit 13 of the plurality of image forming units 13 (left end portion) is disposed to overlap the toner storage unit 60 of another image forming unit 13 adjacent to the one image forming unit 13 among the plurality of image forming units 13 in the axial direction (front-rear direction). According to this configuration, the toner storage units 60 of adjacent image forming units 13 are disposed efficiently, and a size in a right-left direction of the image forming apparatus 10 is reduced. Note that a portion of the toner replenishing unit 5 other than the toner storage unit 60 may be disposed so as to overlap each other as described above.

The image forming apparatus 10 according to the embodiment of the present disclosure has been described in detail above. With such a configuration, there is provided an image forming apparatus that reduces the frequency and time at which the image forming operation stops following replacement of the toner container, and inhibits the horizontal width of the apparatus body 11 from increasing. Note that the present disclosure is not limited to this configuration. The present disclosure can take, for example, the following variations.

(1) The above-described embodiment has described an aspect in which the toner replenishing units 5 and the developing devices 23 are disposed for the four-color toners. However, the present disclosure may be applied to a monochrome image forming apparatus having a structure as shown in FIG. 8.

(2) The above-described embodiment has described an aspect in which the upper toner container 51 and the lower toner container 52 convey the toner therein by rotating main body portions of the containers. However, the toner containers may include rotatable toner conveyance members therein such as screws.

What is claimed is:

1. An image forming apparatus comprising:

an apparatus body;

a plurality of image forming units configured to form respective toner images of colors different from each other; and a transfer unit configured to transfer the toner image onto a sheet, wherein each of the plurality of image forming units includes:

a photoreceptor drum rotated about a predetermined axis and having a peripheral surface that allows formation of an electrostatic latent image and supports the toner image corresponding to the electrostatic latent image;

a developing device configured to supply the photoreceptor drum with the toner to visualize the electrostatic latent image in the toner image, the developing device including a toner replenishing port for internally receiving the toner; and a toner replenishing unit disposed above the developing device and configured to replenish the developing device with the toner through the toner replenishing port, the toner replenishing unit of each of the plurality of image forming units includes:

a first toner container extending along an axial direction of the photoreceptor drum and configured to store and discharge the toner of a predetermined color;

a second toner container extending along the axial direction and configured to store and discharge the toner having the same color as the first toner container;

a first container mounting unit disposed with a space above the developing device in the apparatus body, the first container mounting unit allowing the first toner container to be mounted along a mounting direction parallel to the axial direction and receiving the first toner container;

a second container mounting unit disposed at a position displaced with respect to the first container mounting unit in a direction horizontal and orthogonal to the axial direction above the developing device and below the first container mounting unit in the apparatus body, the second container mounting unit allowing the second toner container to be mounted along the mounting direction and receiving the second toner container; and a toner conveyance unit configured to convey the toner discharged from the first toner container mounted in the first container mounting unit and the second toner container mounted in the second container mounting unit to the developing device, the respective first toner containers of the plurality of image forming units are arranged adjacently to each other in a horizontal direction, the respective second toner containers of the plurality of image forming units are arranged adjacently to each other in the horizontal direction, and each of the first toner container and the second toner container has a cylindrical shape rotating portion extending in the axial direction and configured to store the toner therein, and a fixed portion connected to a leading end of the rotating portion in the mounting direction and configured to discharge the received toner downward, the received toner being received from the rotating portion by the rotation of the rotating portion, each of the first container mounting unit and the second container mounting unit has a hexagon shape having a pair of sides extending in the horizontal direction and supports the rotating portion of the first container and the second container, the first container mounting units are arranged orderly in a manner that the apexes of the neighboring first container mounting units are set face to face at respective apexes, the second container mounting units are arranged orderly in a manner that the apexes of the neighboring second container mounting units are set face to face at respective apexes, an upper side of one of the second container mounting units supports each of the lower side of a pair of the first container mounting units arranged adjacently to each other in the horizontal direction, thereby, when viewed in the axial direction, the first toner containers and the second toner containers of the plurality of image forming units are arranged in such a staggered manner that the first and second toner containers having the same color lie one above the other and shift from each other in the horizontal direction, the toner conveyance unit includes:

a first toner receiving unit engaged with the fixed portion of the first toner container and configured to receive the toner discharged from the fixed portion of the first toner container; and a second toner receiving unit engaged with the fixed portion of the second toner container and configured to receive the toner discharged from the fixed portion of the second toner container.

2. An image forming apparatus comprising:

an apparatus body;

a plurality of image forming units configured to form respective toner images of colors different from each other; and a transfer unit configured to transfer the toner image onto a sheet, wherein each of the plurality of image forming units includes:

a photoreceptor drum rotated about a predetermined axis and having a peripheral surface that allows formation of an electrostatic latent image and supports the toner image corresponding to the electrostatic latent image;

a developing device configured to supply the photoreceptor drum with the toner to visualize the electrostatic latent image in the toner image, the developing device including a toner replenishing port for internally receiving the toner; and a toner replenishing unit disposed above the developing device and configured to replenish the developing device with the toner through the toner replenishing port, the toner replenishing unit of each of the plurality of image forming units includes:

a first toner container extending along an axial direction of the photoreceptor drum and configured to store and discharge the toner of a predetermined color;

a second toner container extending along the axial direction and configured to store and discharge the toner having the same color as the first toner container;

a first container mounting unit disposed with a space above the developing device in the apparatus body, the first container mounting unit allowing the first toner container to be mounted along a mounting direction parallel to the axial direction and receiving the first toner container;

a second container mounting unit disposed at a position displaced with respect to the first container mounting unit in a direction horizontal and orthogonal to the axial direction above the developing device and below the first container mounting unit in the apparatus body, the second container mounting unit allowing the second toner container to be mounted along the mounting direction and receiving the second toner container; and a toner conveyance unit configured to convey the toner discharged from the first toner container mounted in the first container mounting unit and the second toner container mounted in the second container mounting unit to the developing device, the respective first toner containers of the plurality of image forming units are arranged adjacently to each other in a horizontal direction, the respective second toner containers of the plurality of image forming units are arranged adjacently to each other in the horizontal direction, each of the first toner container and the second toner container has a cylindrical shape rotating portion extending in the axial direction and configured to store the toner therein, and a fixed portion connected to a leading end of the rotating portion in the mounting direction and configured to discharge the received toner downward, the received toner being received from the rotating portion by the rotation of the rotating portion, each of the first container mounting unit and the second container mounting unit has a hexagon shape with a pair of sides extending in the horizontal direction and supports the rotating portion of the first container and the second container, the first container mounting units are arranged orderly in a manner that the apexes of the neighboring first container mounting units are set face to face at respective apexes, the second container mounting units are arranged orderly in a manner that the apexes of the neighboring second container mounting units are set face to face at respective apexes, an upper side of one of the second container mounting units supports each of the lower side of a pair of the first container mounting units arranged adjacently to each other in the horizontal direction, thereby, when viewed in the axial direction, the first toner containers and the second toner containers of the plurality of image forming units are arranged in such a staggered manner that the first and second toner containers having the same color lie one above the other and shift from each other in the horizontal direction, the toner conveyance unit includes:

a first toner receiving unit engaged with the fixed portion of the first toner container and configured to receive the toner discharged from the fixed portion of the first toner container;

a second toner receiving unit engaged with the fixed portion of the second toner container and configured to receive the toner discharged from the fixed portion of the second toner container; and a first longitudinal conveyance unit extending downward from the first toner receiving unit, the first longitudinal conveyance unit being configured to convey the toner downward;

the neighboring first longitudinal conveyance units of the plurality of image forming units are disposed so as to sandwich the leading end portion of the second toner container in the mounting direction in a horizontal direction orthogonal to the axial direction.

3. An image forming apparatus comprising:

an apparatus body;

a plurality of image forming units configured to form respective toner images of colors different from each other; and a transfer unit configured to transfer the toner image onto a sheet, wherein each of the plurality of image forming units includes:

a photoreceptor drum rotated about a predetermined axis and having a peripheral surface that allows formation of an electrostatic latent image and supports the toner image corresponding to the electrostatic latent image;

a developing device configured to supply the photoreceptor drum with the toner to visualize the electrostatic latent image in the toner image, the developing device including a toner replenishing port for internally receiving the toner; and a toner replenishing unit disposed above the developing device and configured to replenish the developing device with the toner through the toner replenishing port, the toner replenishing unit of each of the plurality of image forming units includes:

a first toner container extending along an axial direction of the photoreceptor drum and configured to store and discharge the toner of a predetermined color;

a second toner container extending along the axial direction and configured to store and discharge the toner having the same color as the first toner container;

a first container mounting unit disposed with a space above the developing device in the apparatus body, the first container mounting unit allowing the first toner container to be mounted along a mounting direction parallel to the axial direction and receiving the first toner container;

a second container mounting unit disposed at a position displaced with respect to the first container mounting unit in a direction horizontal and orthogonal to the axial direction above the developing device and below the first container mounting unit in the apparatus body, the second container mounting unit allowing the second toner container to be mounted along the mounting direction and receiving the second toner container; and a toner conveyance unit configured to convey the toner discharged from the first toner container mounted in the first container mounting unit and the second toner container mounted in the second container mounting unit to the developing device, the respective first toner containers of the plurality of image forming units are arranged adjacently to each other in a horizontal direction, the respective second toner containers of the plurality of image forming units are arranged adjacently to each other in the horizontal direction, each of the first toner container and the second toner container has a cylindrical shape rotating portion extending in the axial direction and configured to store the toner therein, and a fixed portion connected to a leading end of the rotating portion in the mounting direction and configured to discharge the received toner downward, the received toner being received from the rotating portion by the rotation of the rotating portion, each of the first container mounting unit and the second container mounting unit has a hexagon shape with a pair of sides extending in the horizontal direction and supports the rotating portion of the first container and the second container, the first container mounting units are arranged orderly in a manner that the apexes of the neighboring first container mounting units are set face to face at respective apexes, the second container mounting units are arranged orderly in a manner that the apexes of the neighboring second container mounting units are set face to face at respective apexes, an upper side of one of the second container mounting units supports each of the lower side of a pair of the first container mounting units arranged adjacently to each other in the horizontal direction, thereby, when viewed in the axial direction, the first toner containers and the second toner containers of the plurality of image forming units are arranged in such a staggered manner that the first and second toner containers having the same color lie one above the other and shift from each other in the horizontal direction, the toner conveyance unit has:

a first toner receiving unit engaged with the fixed portion of the first toner container and configured to receive the toner discharged from the fixed portion of the first toner container;

a second toner receiving unit engaged with the fixed portion of the second toner container and configured to receive the toner discharged from the fixed portion of the second toner container;

a specific toner conveyance portion disposed below the first toner receiving unit and the second toner receiving unit, and configured to convey the toner discharged from the first toner container and the second toner container in a specific horizontal direction that makes an acute angle with the axial direction.

4. An image forming apparatus comprising:

an apparatus body;

a plurality of image forming units configured to form respective toner images of colors different from each other; and a transfer unit configured to transfer the toner image onto a sheet, wherein each of the plurality of image forming units includes:

a photoreceptor drum rotated about a predetermined axis and having a peripheral surface that allows formation of an electrostatic latent image and supports the toner image corresponding to the electrostatic latent image;

a developing device configured to supply the photoreceptor drum with the toner to visualize the electrostatic latent image in the toner image, the developing device including a toner replenishing port for internally receiving the toner; and a toner replenishing unit disposed above the developing device and configured to replenish the developing device with the toner through the toner replenishing port, the toner replenishing unit of each of the plurality of image forming units includes:

a first toner container extending along an axial direction of the photoreceptor drum and configured to store and discharge the toner of a predetermined color;

a second toner container extending along the axial direction and configured to store and discharge the toner having the same color as the first toner container;

a first container mounting unit disposed with a space above the developing device in the apparatus body, the first container mounting unit allowing the first toner container to be mounted along a mounting direction parallel to the axial direction and receiving the first toner container;

a second container mounting unit disposed at a position displaced with respect to the first container mounting unit in a direction horizontal and orthogonal to the axial direction above the developing device and below the first container mounting unit in the apparatus body, the second container mounting unit allowing the second toner container to be mounted along the mounting direction and receiving the second toner container; and a toner conveyance unit configured to convey the toner discharged from the first toner container mounted in the first container mounting unit and the second toner container mounted in the second container mounting unit to the developing device, the respective first toner containers of the plurality of image forming units are arranged adjacently to each other in a horizontal direction, the respective second toner containers of the plurality of image forming units are arranged adjacently to each other in the horizontal direction, each of the first toner container and the second toner container has a cylindrical shape rotating portion extending in the axial direction and configured to store the toner therein, and a fixed portion connected to a leading end of the rotating portion in the mounting direction and configured to discharge the received toner downward, the received toner being received from the rotating portion by the rotation of the rotating portion, each of the first container mounting unit and the second container mounting unit has a hexagon shape with a pair of sides extending in the horizontal direction and supports the rotating portion of the first container and the second container, the first container mounting units are arranged orderly in a manner that the apexes of the neighboring first container mounting units are set face to face at respective apexes, the second container mounting units are arranged orderly in a manner that the apexes of the second container mounting units are set face to face at respective apexes, an upper side of one of the second container mounting units supports each of the lower side of a pair of the first container mounting units arranged adjacently to each other in the horizontal direction, thereby, when viewed in the axial direction, the first toner containers and the second toner containers of the plurality of image forming units are arranged in such a staggered manner that the first and second toner containers having the same color lie one above the other and shift from each other in the horizontal direction, the toner conveyance unit includes:

a first toner receiving unit engaged with the fixed portion of the first toner container and configured to receive the toner discharged from the fixed portion of the first toner container;

a second toner receiving unit engaged with the fixed portion of the second toner container and configured to receive the toner discharged from the fixed portion of the second toner container;

a horizontal conveyance unit disposed below the first toner receiving unit and the second toner receiving unit, and receiving the toner from the first toner container or the second toner container and conveying the toner in a horizontal direction; and a toner supply unit extending downward from a downstream end of the horizontal conveying unit in a mounting direction of the first and second toner containers, the toner supply unit being configured to supply the developing device with the toner.

* * * * *